US006726437B2

(12) United States Patent
Albright et al.

(10) Patent No.: US 6,726,437 B2
(45) Date of Patent: Apr. 27, 2004

(54) TELESCOPING LOADER LIFT ARM

(75) Inventors: Larry E. Albright, Gwinner, ND (US); Thomas J. Roan, Fargo, ND (US); Gregory L. Fischer, Lake City, SD (US)

(73) Assignee: Clark Equipment Company, Woodcliff Lake, NJ (US)

( * ) Notice: Subject to any disclaimer, the term of this patent is extended or adjusted under 35 U.S.C. 154(b) by 18 days.

(21) Appl. No.: 10/123,469

(22) Filed: Apr. 15, 2002

(65) Prior Publication Data

US 2003/0152454 A1 Aug. 14, 2003

Related U.S. Application Data

(60) Provisional application No. 60/355,209, filed on Feb. 8, 2002.

(51) Int. Cl.[7] ..... B66C 23/04

(52) U.S. Cl. ..... 414/728; 414/718; 52/118

(58) Field of Search ..... 414/728, 718; 212/177, 264, 299, 348, 349, 350; 52/118

(56) References Cited

U.S. PATENT DOCUMENTS

| | | | | |
|---|---|---|---|---|
| 2,698,106 | A | 12/1954 | McElhinney et al. | |
| 2,701,072 | A | 2/1955 | Chambers et al. | |
| 2,791,341 | A | 5/1957 | Michaels et al. | |
| 2,990,072 | A | 6/1961 | Mindrum | |
| 3,178,046 | A | 4/1965 | Lull | |
| 3,390,794 | A | 7/1968 | McMullen et al. | |
| 3,624,785 | A | 11/1971 | Wilson | |
| D224,128 | S | 7/1972 | Sterner | D41/0 |
| 3,708,937 | A | 1/1973 | Sterner | 52/118 |
| 3,802,136 | A | 4/1974 | Eiler et al. | 52/115 |
| 3,985,234 | A | 10/1976 | Jouffray | 212/144 |
| 4,004,695 | A | 1/1977 | Hockensmith et al. | 212/144 |
| 4,045,936 | A | 9/1977 | Sterner | 52/632 |
| 4,098,172 | A | 7/1978 | Wright et al. | 92/161 |
| 4,133,411 | A | 1/1979 | Curb | 182/2 |
| 4,134,236 | A | 1/1979 | Ott | 52/118 |
| 4,162,873 | A | 7/1979 | Smith, Jr. | 414/718 |
| 4,257,201 | A | 3/1981 | Landolt et al. | 52/118 |
| 4,280,783 | A | 7/1981 | Hayward | 414/686 |
| 4,295,771 | A | 10/1981 | Mehesan, Jr. | 414/5 |
| 4,306,832 | A | 12/1981 | Schmiesing | 414/718 |
| 4,327,533 | A | 5/1982 | Sterner | 52/115 |
| 4,403,427 | A | 9/1983 | Dahlquist | 37/2 |
| 4,459,786 | A | 7/1984 | Pitman et al. | 52/115 |
| 4,553,899 | A | 11/1985 | Magni | 414/629 |
| 4,728,249 | A | 3/1988 | Gano | 414/718 |
| 4,741,662 | A | 5/1988 | Schmiesing | 414/686 |
| 4,793,765 | A | 12/1988 | Paul et al. | 414/718 |
| 4,999,022 | A | 3/1991 | Veys | 414/718 |
| 5,101,215 | A | 3/1992 | Creaser, Jr. | 343/883 |
| 5,158,189 | A | 10/1992 | Watson et al. | 212/269 |
| 5,515,654 | A | 5/1996 | Anderson | 52/118 |
| 5,611,657 | A | 3/1997 | Peterson | 414/722 |
| 5,769,251 | A | 6/1998 | Wada et al. | 212/289 |
| 5,865,328 | A | 2/1999 | Kaspar | 212/350 |
| 5,884,791 | A | 3/1999 | Vohdin et al. | 212/348 |

FOREIGN PATENT DOCUMENTS

| | | | | |
|---|---|---|---|---|
| DE | 2205093 | * | 8/1973 | 212/350 X |

* cited by examiner

*Primary Examiner*—Donald W. Underwood
(74) *Attorney, Agent, or Firm*—Westman, Champlin & Kelly

(57) ABSTRACT

A telescoping lift arm assembly has an outer lift arm tube that is formed with a cross section configuration that has spaced side walls, and outwardly extending flange guide panels at the lower portions of the side walls. An inner lift arm tube is generally bell-shaped and fits into the outer lift arm tube and has outwardly flared flanges that are parallel to the flange guide panels of the outer lift arm tube. The inner lift arm tube is held in place with a cross support plate that is supported to the side walls of the outer lift arm tube, to hold the inner lift arm tube in place. There are linear bearings between the mating outwardly flared flanges and panels, as well as between the support plate and mating lower surfaces of the inner lift arm tube. Fasteners are provided to adjustably hold the support plate secured to the outer lift arm tube.

27 Claims, 8 Drawing Sheets

TELESCOPING LOADER LIFT ARM

The present application is based on and claims the benefit of U.S. provisional patent application Ser. No. 60/355,209, filed Feb. 8, 2002, the content of which is hereby incorporated by reference in its entirety.

BACKGROUND OF THE INVENTION

The present invention relates to telescoping lift arms that may be used for loader arms, either in pairs or as an individual, single boom, and which have a bell shaped cross section that permits an inner lift arm to slide or telescope relative to an outer lift arm and to be guided along linear bearings. The clearance of guide surfaces between inner lift arm and outer lift arm can be changed to adjust for wear without disassembly and replacement of the linear bearings.

Telescoping lift arms have been well known, and used in various applications, including front end loaders, crane booms, and the like. Various lift arm cross sections have been used for the telescoping lift arms, but the ability to adjust the fit or wear surface clearance of the sliding bearings or wear pads used after the bearings have fully seated, or have become worn, has been difficult. Replacement of bearings is usually necessary from time to time during use. This results in down time of the equipment, as well as extra expense for maintenance.

Rollers have been utilized for supporting the inner lift arm section, but rollers also become worn and are difficult to adjust.

SUMMARY OF THE INVENTION

The present invention relates to a telescoping lift arm assembly having inner and outer lift arm sections that are channel shaped and are formed so the inner section slidably nests in the outer section. The sliding arm channel have cross sections that flare out along the lower side edges. The lift arms thus have essentially "bell shaped" cross sections. The lower side of the inner telescoping lift arm is closed to form a tube that is supported relative to the lower edge portions of the outer lift arm sections only. There is clearance between the lift arm tubes at the top of the inner sections.

The flared lower wall portions of the inner lift arm tube have outer surfaces that are supported through linear bearings on complementary shaped inner surface portions of the outer lift arm section. The inner lift arm section is closed with a generally flat or planar bottom plate that is fixed in place and supported on an outer adjustable, and preferably removable lower plate forming the bottom wall of the outer lift arm tube.

The removable bottom plate of the outer lift arm tube can be adjustably clamped in place, with low coefficient linear bearing or wear pads between the bottom plates of the inner and outer lift arm tubes, and between the flared lower edge portions of the lift arm tubes. The linear bearings provide low friction, non binding support. The bottom plate of the outer lift arm tube will be moved toward the inner tube as it is tightened in place. Shims are used to positively position the outer lift arm bottom plate and permit tightening the adjusting bolts without directly affecting the load on the linear bearings.

The clearances of the linear bearings that are between guide surfaces of the inner and outer lift arm tubes can be adjusted. The adjustment of the bottom plate of the outer lift arm section can be made to compensate for wear on the linear bearings or wear pads.

The removable bottom plate or wall of the outer lift arm tube also makes assembly of the two nesting arm tubes easy, as well as permitting easy installation, adjustment and replacement of the linear bearings or wear pads. The outer adjustable and removable bottom plate permits the inner lift arm tube to be slipped up into the open bottom of the outer lift arm tube, and with the linear bearings also installed, the bottom plate is put into place and adjusted, preferably with shims, to provide the appropriate loading of the linear bearings between the two telescoping lift arm tubes.

The bottom plate wall may have notches on its edges, the side walls of the outer lift arm have inturned tabs that fit into the notches to positively position the bottom plate in longitudinal directin and to prevent it from moving with the inner lift arm when the inner lift arm tube telescopes.

The extension and retraction of the inner lift arm tube is done in a conventional manner with a double acting hydraulic cylinder connected between the two telescoping tubes and positioned within the lift arm tubes.

DETAILED DESCRIPTION OF THE PREFERRED EMBODIMENTS

Figure 1:
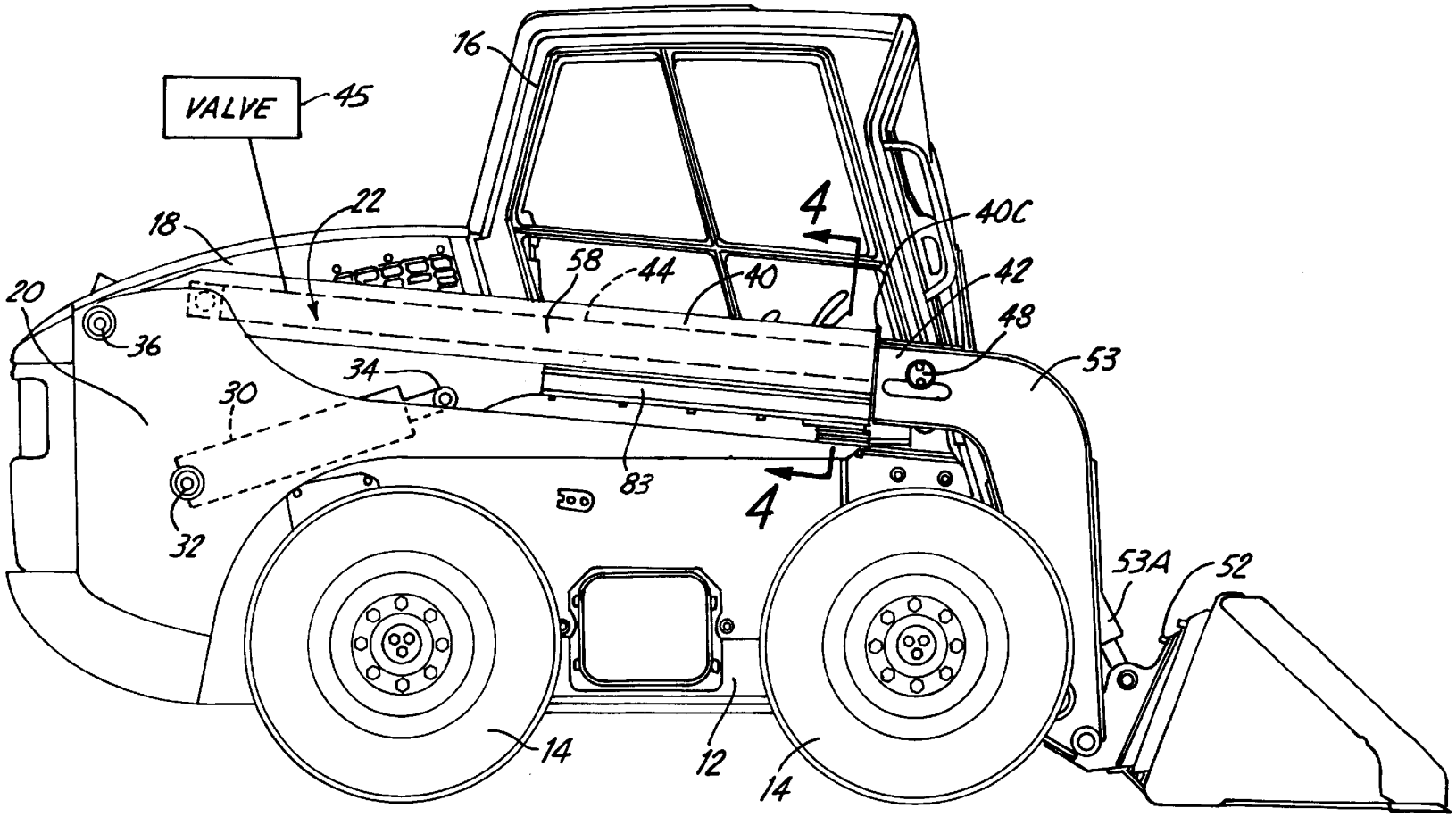
FIG. 1 is a schematic side elevational view of a typical skid steer loader having a telescoping loader arm boom made according to the present invention, with parts broken away.

FIG. 1 is a schematic representation of the skid steer loader indicated at 10 that has a frame 12, and drive wheels 14 for propelling the loader across the ground. Frame 12 supports an operator's cab 16, and an engine compartment 18 for housing the engine (not shown). The frame 12 also includes boom support plates or frame members 20 on which a telescoping lift arm assembly 22 is pivotally mounted on pivots 36. The lift arm assembly 22 comprises individual lift arms 24 and 26, one pivoted on each of the opposite sides of the skid steer loader. The two lift arms are identical except that one is on the right hand side and the other is on the left hand side.

The lift arm assembly 22 is made up of individual inner lift arm tube 42 held in an outer, complentory shaped outer arm tube 40. The inner tubes 42 are held together with a suitable cross member 28 at the forward ends of the inner lift arm tubes or sections 42. The outer end of lift arm assembly 22 is raised and lowered by pivoting the lift arm assembly about the pivots 36 with hydraulic cylinders 30 that have base end pivots 32 connected to the vehicle frame, and rod ends connected at pivots 34 to the lift arms 24 and 26. The actuators 30 are controlled in a conventional manner using suitable valves in the hydraulic system of the skid steer loader.

Figure 2:
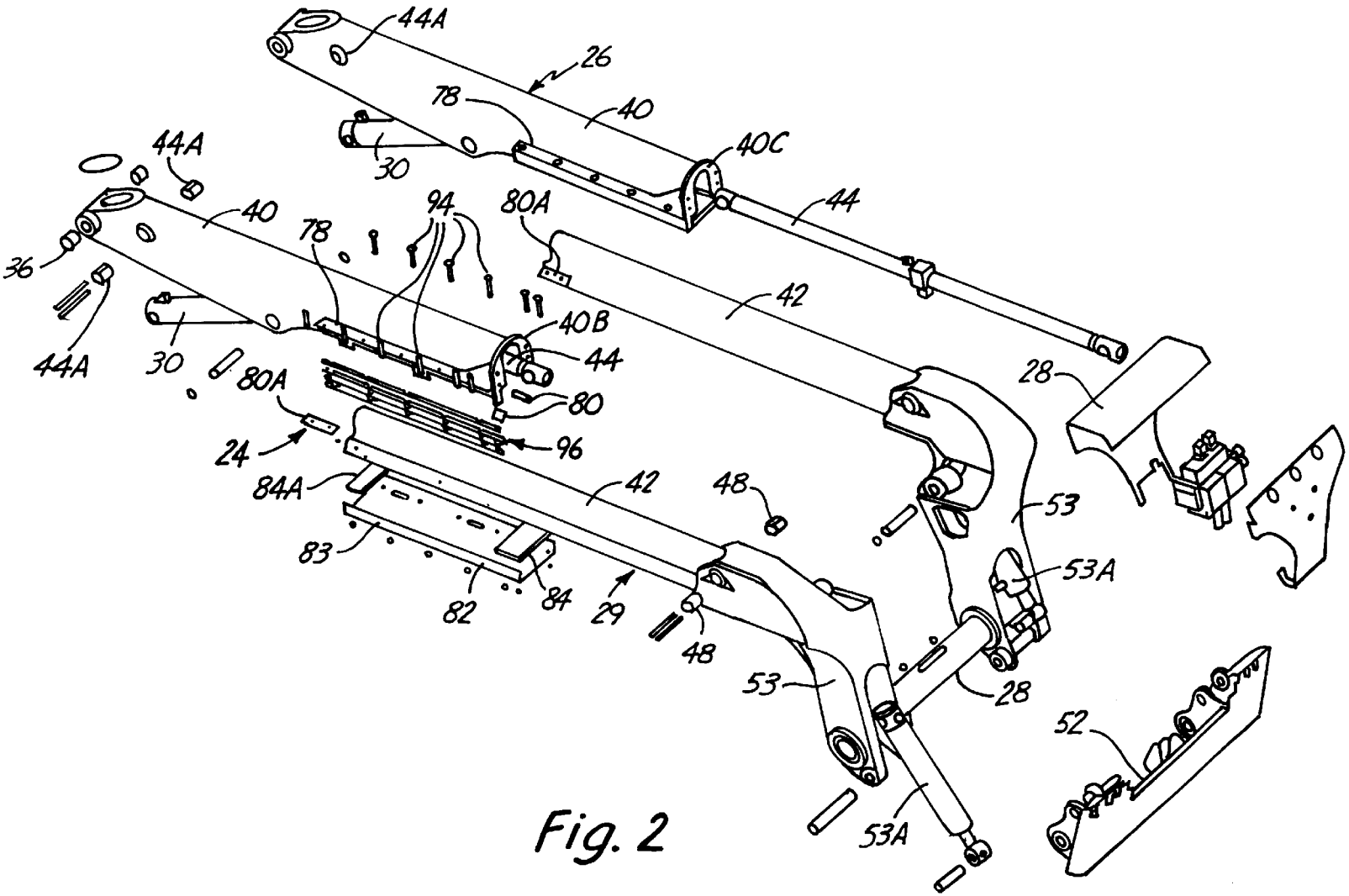
FIG. 2 is an exploded perspective view of a pair of a lift arm assembly of the present invention.

The telescoping lift arms 24 and 26 are identical in cross section and the telescoping lift arm 24 will be shown in most detail. Each of the telescoping tubular lift arms includes the main outer lift arm tube or housing 40 and the telescoping inner lift arm tubes 42. The inner lift arm tubes 42 telescope relative to the outer lift arm tubes 40 as an inner assembly 29. The lift arm tube 42's fit inside the outer lift arm tubes 40 and slide longitudinally relative thereto. The assembly 29 of the inner lift arm tubes is moved as a unit through the use of double acting hydraulic actuators 44 in a conventional manner. The hydraulic actuators 44 in FIGS. 1 and 2 are merely representative of the types of actuators that can be used for telescoping movement of the inner lift arm tubes.

As shown, the base ends of actuators 44 are mounted to the outer lift arm housings or tubes on pins 44A, so that the actuators 44 pivot up and down with the outer lift arm tubes 40. Each actuator 44 has a rod end pivotally connected with pins 48 to the inner lift arm tubes 42 so that upon extending and retracting the actuators or cylinders 44 with a suitable valve 45, the inner lift arm tubes 42 can be extended and retracted as desired. The inner lift arm tube assembly 29, as shown, has a tool or accessory attachment connection plate 52 at its outer or forward ends. Depending side frames 53 that are fixed to the inner lift arm tubes 42 and the frames are connected with a cross member 28. The attachment plate is pivotally mounted to the lower ends of the side frame 53 and controlled with control cylinders 53A. Also note that the cross member 28 can be used for mounting a hydraulic valve.

Figure 3:
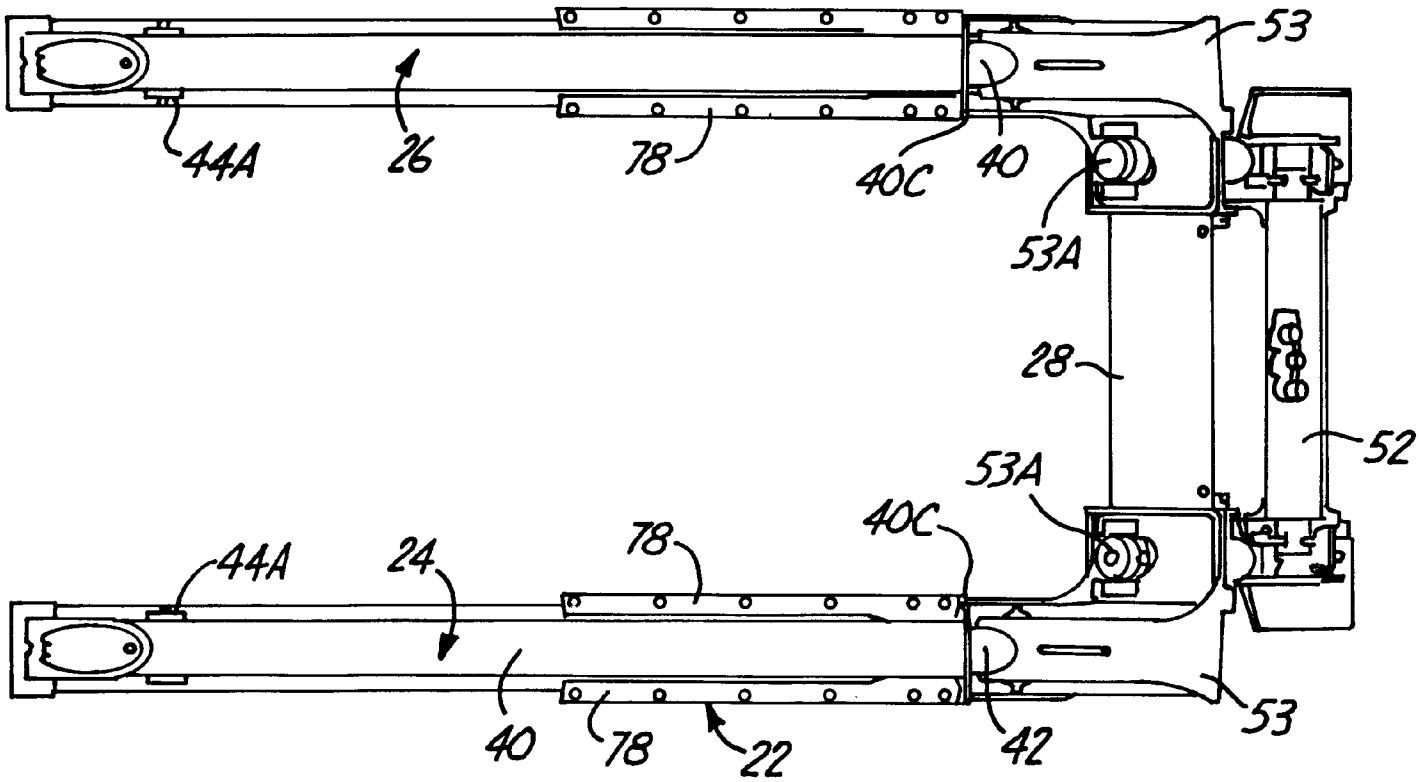
FIG. 3 is a top plan view of the lift arm assembly of lift arm of the present invention.
Figure 4:
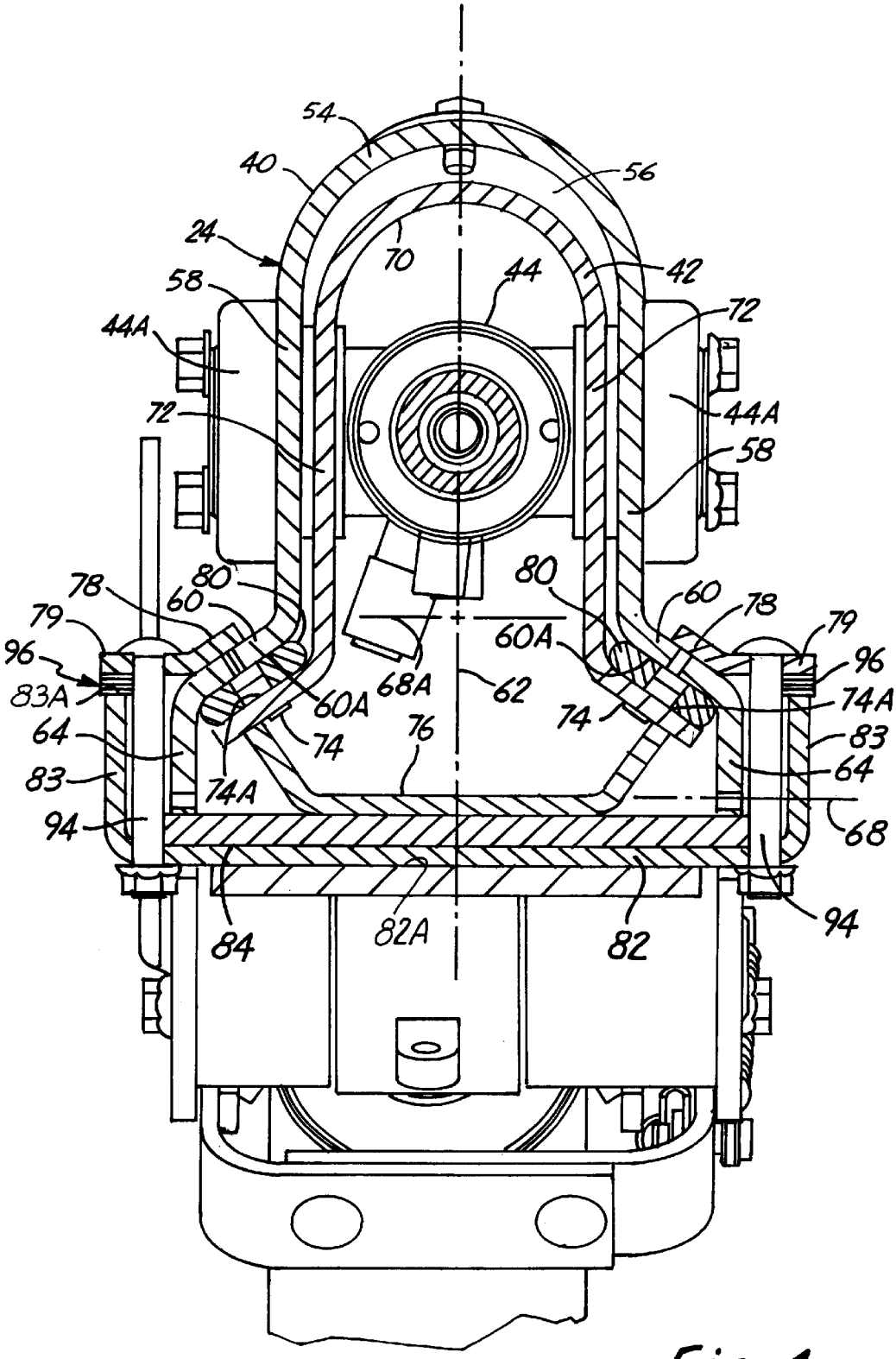
FIG. 4 is a sectional view of a first cross sectional shape of the lift arm taken on lines 4—4 in FIG. 1.

The cross sections of the outer lift arm tubes or housings and the inner telescoping tube lift arm tubes of the present invention provide several advantages, including the ability for quick adjustment for wear and also for ease of assembly. In FIG. 4, one lift arm 24 of the assembly 22 is illustrated in cross section. The outer lift arm housing 40, as shown, forms an interior chamber 56, in which the inner lift arm tube 42 is housed for telescoping. A part cylindrical upper portion 54 of outer lift arm tube 40 joins planar spaced, parallel side walls 58 on opposite sides of the inner lift arm tube 40. The walls 58 have lower flared out guide panels 60 that extend laterally outwardly from a central bisecting plane 62, on both sides of the outer lift arm tube 40 to provide support surfaces 60A on the inside of the flared out guide panels 60. The guide panels 60 then join downwardly extending flanges 64, the planes of which are parallel to walls 58 and plane 62 and perpendicular relative to a plane 68 that is perpendicular to the plane 62. As can be seen in FIGS. 1, 2 and 3, the guide panels 60 extend from the front of the outer lift arm tubes rearwardly to support the desired length of the inner lift arm tube when the inner tube is retracted and to provide support for the inner tube as it is extended.

Each inner lift arm tube 42 nests in the respective outer lift arm tube and has a semi-cylindrical upper wall portion 70. The part cylindrical wall extends around a central axis 180°, to join side walls 72 parallel to and spaced slightly inwardly from the planar side walls 58 of the outer lift arm tube 40. The inner lift arm tube 42 has outwardly flared, planar walls or flanges 74 below or inside of the guide panels 60. The walls or flanges 74 that flare outwardly are parallel to the guide panels 60 of the outer lift arm tube 40, and have outer upwardly facing surfaces 74A that face the inner surfaces 60A of the guide panels. The flanges 74 extend for the full longitudinal length of the inner lift arm tube 42.

The inner lift arm tube 42 then is enclosed with a bottom plate 76 that has angled side flanges 78 that are welded to the undersides of walls or flanges 74 to form a rigid tube with a bell shaped cross section.

When the inner lift arm tube 42 is positioned in the outer lift arm tube 40, it can be seen that the maximum width of the part cylindrical portion 70 of the inner lift arm tube 42 is less than the width between the wall panels 58, so the upper part cylindrical section 70 of the inner lift arm tube will slip up into the outer lift arm tube or housing 40 from the bottom, when a removable bottom support or retaining plate 82 is removed from the outer lift arm tube. The bottom plate 82 has upturned side walls or flanges 83 that are parallel to and spaced to the outside of the flanges 64 of the outer lift arm section 40. The flanges 60 of the outer lift arm tubes 40 have clamping flanges 78 welded thereto and the flanges have lips 79 that extend laterally outwardly to overlie the upper edge surface 83A of flange 83 attached to the bottom plate 82.

The clamping flanges 78 extend from the front of the outer lift arm tubes about one-half the length of the outer lift arm tube, which is sufficient to stabilize the inner lift arm assembly as it is extended and retracted. Linear bearings or wear pads 80 and 80A are positioned between the surfaces 60A and 74A on each side of the lift arm assembly 24. Wear pads 80A are secured on top of and at the rear of the walls 74 with dowel pins, as can be seen in FIGS. 2 and 3. The wear pads 80 are secured to panels 60 at the front of the outer lift arm tube 40 with dowel pins.

The short wear pads or linear bearing provide wear bearings to guide the properly positioned inner lift arm tubes 42 relative to the outer lift arm tubes or housings 40. These linear bearings 80 and 80A are short and used to support the inner lift arm assembly as it moves. They can be at more than two longitudinally spaced intervals if desired.

Also, the wear pads or linear bearings are below the neutral axis of the lift arm tubes under bending loads. The neutral axis is approximately along a plane 68A shown in FIG. 4.

The lift arm assembly 24 is completed by adjustably securing the removable bottom support plate 82 to the upper portion of the lift arm tube 40 using bolts, and shims as will be explained. The support plate 82 is parallel to the bottom plate 76 of the inner lift arm tube 42. The bolt 94 for plate 82 retain spaced short linear guide bearings 84 in and 84A in longitudinal position for slidably guiding the inner lift arm tubes. The linear guide bearings are positioned by plate 82 for supporting the bottom plate 76 of the respective inner lift arm tubes.

A collar 40C is provided at the end of outer lift arm tube for reinforcing the side walls of the outer tube and adding rigidity to the side walls of the outer tube.

The linear guide bearings can be constructed in different forms as shown. In either form the inner or upper surface 82A of removable plate 82 of each outer lift arm tube 40 holds the linear bearings 84 and 84A in position to provide a support for the respectively inner lift arm tube 42 to hold it in place.

Linear bearings 80 and 84 are shown in FIG. 4 and linear bearing 84A and 80A are as shown in FIG. 2. The linear bearings provide guides for the inner lift arm tube, with the linear bearings or wear pads 84 and 84A carrying the major loads or forces, and the linear bearings 80 and 80A forming reaction surfaces for keeping the inner lift arm tube properly positioned and preventing "play" or looseness in the sliding action. The linear bearings 80, 80A and 84 and 84A can be self-lubricating composite materials, or can be polytetrafluoroethylene or similar low coefficient of friction material.

The removable support plate 82 has side walls or flanges 83 that are parallel to the wall sections 64, and a series of bolts 94 on the opposite sides of the lift arms 24 and 26 are provided in openings through the outwardly extending lips 79 of the reaction flanges 78 on each upper lift arm tube 40 and through openings in the bottom plate 82. The edges of the linear bearings 84 and 84A can be notched to fit around the bolts 94 to hold the bearings from sliding in use. The edges of the walls or flanges 83 facing the lips 79 support shims 96 that are used to correctly space wall 82 so the flanges 74 of inner lift arm tube 42 on each side of the assembly are maintained at the proper spacing or clearance from guide panels 60 so the linear bearings carry the necessary loads. The inner and outer tubes are not clamped tightly and are shimmed so they are not loose, when bolts 94 are tightened fully. The bolts 94 are under the correct tension to maintain the spacing and not work loose.

There are several shims 96 of proper thickness and as the linear bearings wear, the bolts 94 can be loosened and one or more shims removed. The bolts 96 can be retightened to provide adjustment. The adjustment will ensure that the inner lift arm tube does not have "play" but is properly guided.

As can be seen in FIGS. 2 and 3, the bolts 94 can be spaced at regular intervals along the flared guide panels 60 to provide adequate tightening and smooth sliding support for the inner lift arm tube. The shims 96 have U-shaped notches to slide over the bolts 94 so they can be removed outwardly, but are held in place and are clamped as the bolts 94 are torqued to full tightness.

Figure 5:
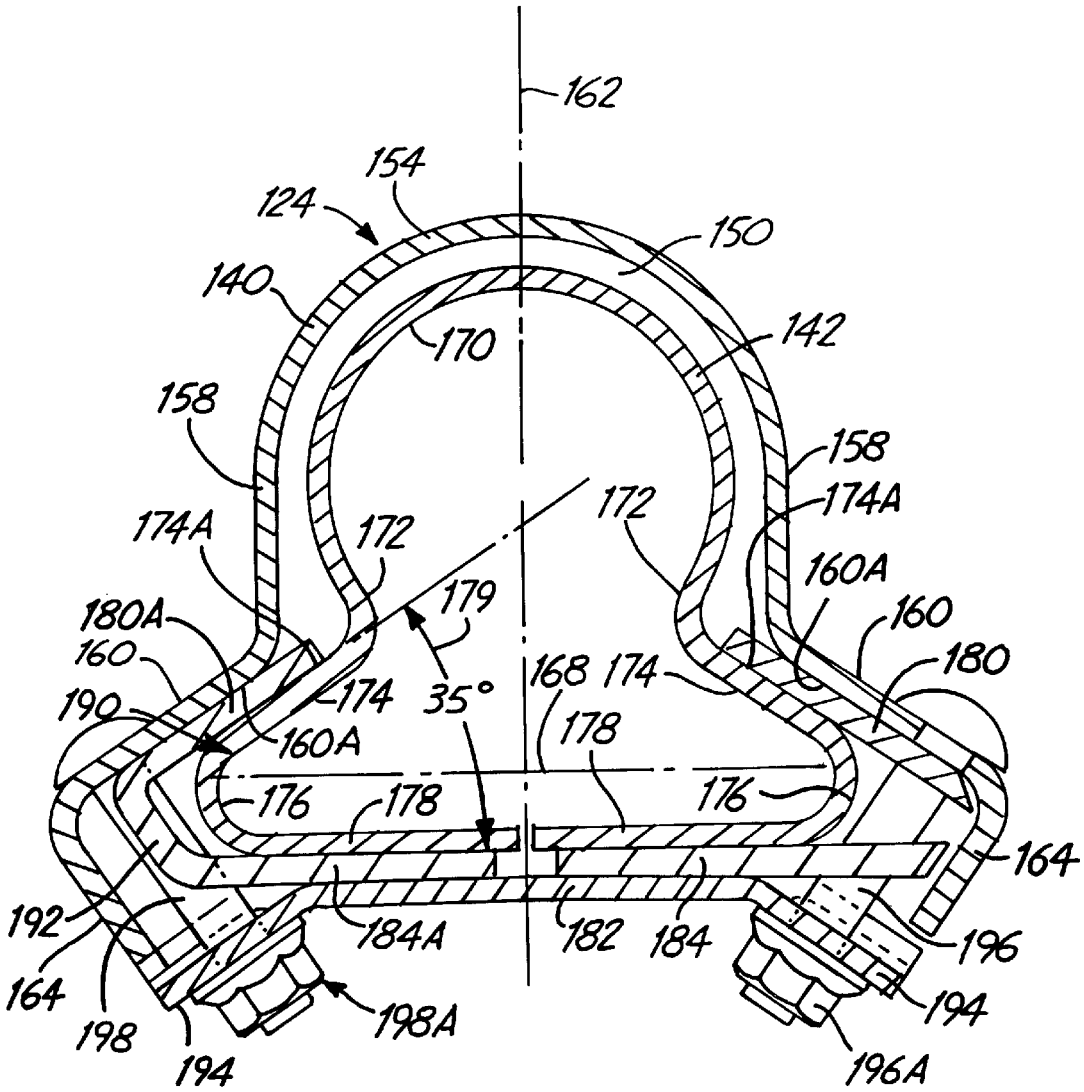
FIG. 5 is a cross sectional view taken on line 4—4, but showing a modified cross sectional shape for the lift arm.

FIG. 5 shows an alternative cross section lift arm. The outer lift arm housing 140, as shown, forms an interior chamber 150, in which an inner lift arm tube 142 is housed for telescoping. A part cylindrical upper portion 154 of outer lift arm tube 140 joins planar spaced, parallel side walls 158 on opposite sides of the inner lift arm tube 140. The walls 158 have lower flared out guide panels 160 that extend laterally outwardly from a central bisecting plane 162 on both sides of the outer lift arm tube 140 to provide support surfaces 160A on the inside of the flared out guide panels 160. The guide panels 160 then join inwardly extending flanges 164, the planes of which are inclined inwardly at an angle relative to the central bisecting plane 162 and relative to a plane 168 that is perpendicular to the plane 162.

Each inner lift arm tube 142 nests in the outer lift arm tube and has a part-cylindrical upper wall portion 170. The part-cylindrical wall extends around a central longitudinal axis more than 180°, to form a necked down section formed by inwardly indented wall portions 172 inside of and spaced from the planar side wall panels 158 of the outer lift arm tube 140. The inner lift arm tube 142 has outwardly flared, planar walls or flanges 174 below the necked down portions 172. The walls or flanges 174 flare outwardly and are parallel to the guide panels 160 of the outer lift arm tube, and have outer upwardly facing surfaces 174A that face the inner surfaces 160A of the outer lift arm tube.

The inner lift arm tube 142 then has rounded lower corner edge portions 176, that are integral with inwardly turned support flanges 178 that are parallel to the plane 168, and generally perpendicular to central bisecting plane 162. These support flanges 178 are coplanar and extend toward plane 162. The support flanges 178 can be welded together where their edges meet in the center, or left unattached. The flanges 178 form a bottom wall of the inner lift arm tube. The angle of the plane of the flared panels 160 and the outwardly flared walls 174 relative to flanges 178 can be selected as desired, and as shown, the angle indicated by double arrow 179 is about 35°.

When the inner lift arm tube 142 is positioned in the outer lift arm tube 140, it can be seen that the maximum width of the part cylindrical portion 170 of the inner lift arm tube 142 is less than the width between the outer lift arm wall panels 158, so the upper part cylindrical section 170 of the inner lift arm tube will slip up into the outer boom tube or housing 140 from the bottom or when a removable bottom support or retaining plate 182 is removed from the outer lift arm tube.

Linear bearings or pads 180 and 180A are positioned between the surfaces 160A and 174A on each side of the lift arm assembly 124 and provide wear bearings to guide the properly positioned inner lift arm tube 142 relative to the outer lift arm tube or housing 140. These linear bearings 180 and 180A can be continuous along the length of the lift arms, or can be at longitudinally spaced intervals, as desired.

The lift arm 124 is completed by securing the removable bottom support plate 182 to the upper portion of the lift arm tube 140 at a desired position. The support plate 182 has its main planar panel parallel to the flanges 178, and the plate 182 retains linear guide bearings 184 and 184A in position on the surfaces 178A of the flanges 178, as shown.

The linear guide bearings 184 and 184A can be constructed in different forms as shown. In either form, the inner or upper surface 182A of removable plate 182 bears against the bearings 184 and 184A and provides a support for the inner lift arm tube 142 to hold it in place.

In one form, the linear bearing 184A joins the linear bearing 180A at a junction section to form a linear bearing assembly 190 has a junction section 192 that joins linear bearings 180A and 184A. The bearings at the top and bottom thus can be one sheet that is bent to provide bearings between the load carrying, and relatively sliding surfaces.

On the right hand side of FIG. 5, linear bearings 180 and 184 are separated, but in either case the linear bearings provide guides for the inner lift arm tube, with the bearings 184 and 184A carrying the major loads or forces, and the linear bearings 180 and 180A forming reaction surfaces for keeping the inner lift arm tube properly positioned.

The removable support plate 182 has side flanges 194 which are bent downwardly so they are parallel to the guide panels 160 and perpendicular to the wall sections 164. A series of bolts 196 and 198 on the opposite sides of each lift arm are provided in openings through the outwardly flared guide panels 160 and the flanges 194 of the support plate 182. The bolts 196 and 198 also pass through the edges of the linear bearings 180, 180A, 184 and 184A to hold them from sliding in use. As shown, lock nuts 196A and 198A can be tightened so that the support plate 182 is moved up against the panels or flanges 178 and this will move the outwardly flared walls 174 so that surfaces 174A bear against linear bearings 180 and 180A. The support plate has a die formed seat or projection 194D around each opening for the bolts 196 and 198 to provide a seat surface for the nuts 196A and 198A. The seat for the nuts also can be provided with a specially shaped washer. Shims can be provided between the flanges 194D and the edges of flanges 164 for proper spacing.

Shims can be added or removed and the bolts 196 and 198 can be tightened against remaining shims to provide adjustment to provide take up and tightening of the inner lift arm tube 142 relative to the support surfaces of outer lift arm tube or housing 140 as wear occurs. The adjustment will ensure that the inner lift arm tube does not have "play" but is properly guided.

Figure 6:
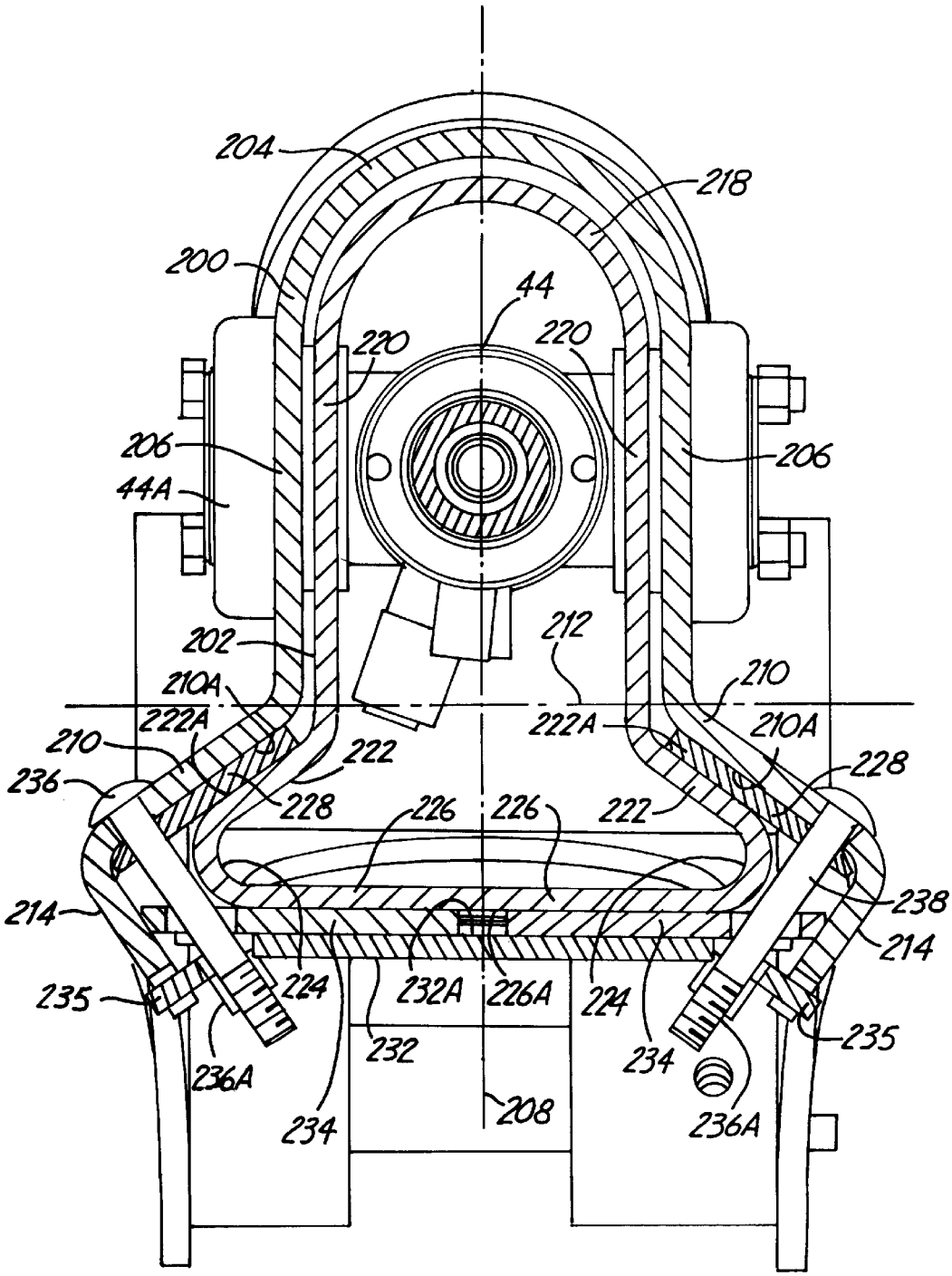
FIG. 6 is a cross sectional view of a modified lift arm.

The bolts 198 and 196 can be spaced at regular intervals along the flared panels 60 as shown in FIG. 6 to provide adequate tightening movement and smooth sliding support for the inner lift arm tube 142.

FIG. 6 illustrates a modified cross section of the lift arm assemblies. The lift arm assemblies. The lift arm assembly indicated at 224 in FIG. 4 has an outer lift arm tube or housing 200, and an inner lift arm tube 202 that nest together and which will telescope longitudinally. The lift cylinder 44 is illustrated in position, inside the inner lift arm tube 202. In this form of invention, the lift arm tube or housing 200 has a part cylindrical upper portion 204, with elongated generally vertical, spaced side walls 206, which form a deep inverted U-shape. The side walls 206 are parallel to the central longitudinal dividing plane of the lift arm indicated at 208. Outwardly flared wall panels 210, which correspond to the guide panels 60 in FIG. 4 and 60 in FIG. 5, join the vertical wall sections 206 and flare outwardly at an angle relative to the central longitudinal vertical plane 208. Also the panels 210 are inclined at an angle relative to a plane indicated at 212 that is perpendicular to the plane 208. Plane 212 is approximately shown along the neutral bending axis of the lift arm. The flared panels 210 are joined to bent in flanges 214, that extend inwardly toward the central plane 208, at a selected, suitable angle.

The inner lift arm tube 202 has a part cylindrical top portion 218, that is spaced from the inner surface of the top part cylindrical portion 204 of the outer lift arm tube or housing 200. The inner lift arm tube 202 has vertical side wall panels 220 joining the part cylindrical section 218, which side wall panels extend parallel to and are spaced from the interior surfaces of walls 206 of the outer lift arm tube. The hydraulic cylinder 44 (numbered as before) is mounted between the wall panels 220 on the pin 44A.

In this form of the invention, the inner lift arm tube is also bell-shaped in cross section, and has outwardly extending flanges 222 at the lower ends of the wall panels 220, which are parallel to the wall panels 210. The inner surfaces 210A of the wall panels 210 face outer surfaces 222A of the inner lift arm tube flanges 222. The flanges 222 have in-turned edge portions or rails 224 that join inwardly directed support flanges 226 which extend in toward the central plane 208. The flanges 226, as can be seen, are perpendicular to the plane 208 and parallel to the plane 212. The flanges 222 and wall panels 210 are inclined relative to both the vertical and horizontal planes. The flanges 226 are made as one continuous bottom wall panel, and the inner tube can be a integrally drawn or formed.

Linear bearings 228 are provided between the surfaces 210A and 222A, on each side of the lift arm and provide for a sliding bearing for telescoping the inner lift arm tube 202 relative to the outer lift arm tube 200.

The inner lift arm tube 202 is retained in place and is adjusted in position with a bottom support wall or retainer plate 232 that is parallel to the flanges 226. Linear bearings 234 are positioned between the outer or lower surfaces 226A of the inner tube support flanges 226, and the upper surface 232A of the support or retainer plate 232. The plate 232 also has edge flanges 235 that extend longitudinally and are parallel to the planes of the panels 210 and the flared out flanges 222.

Figure 7:
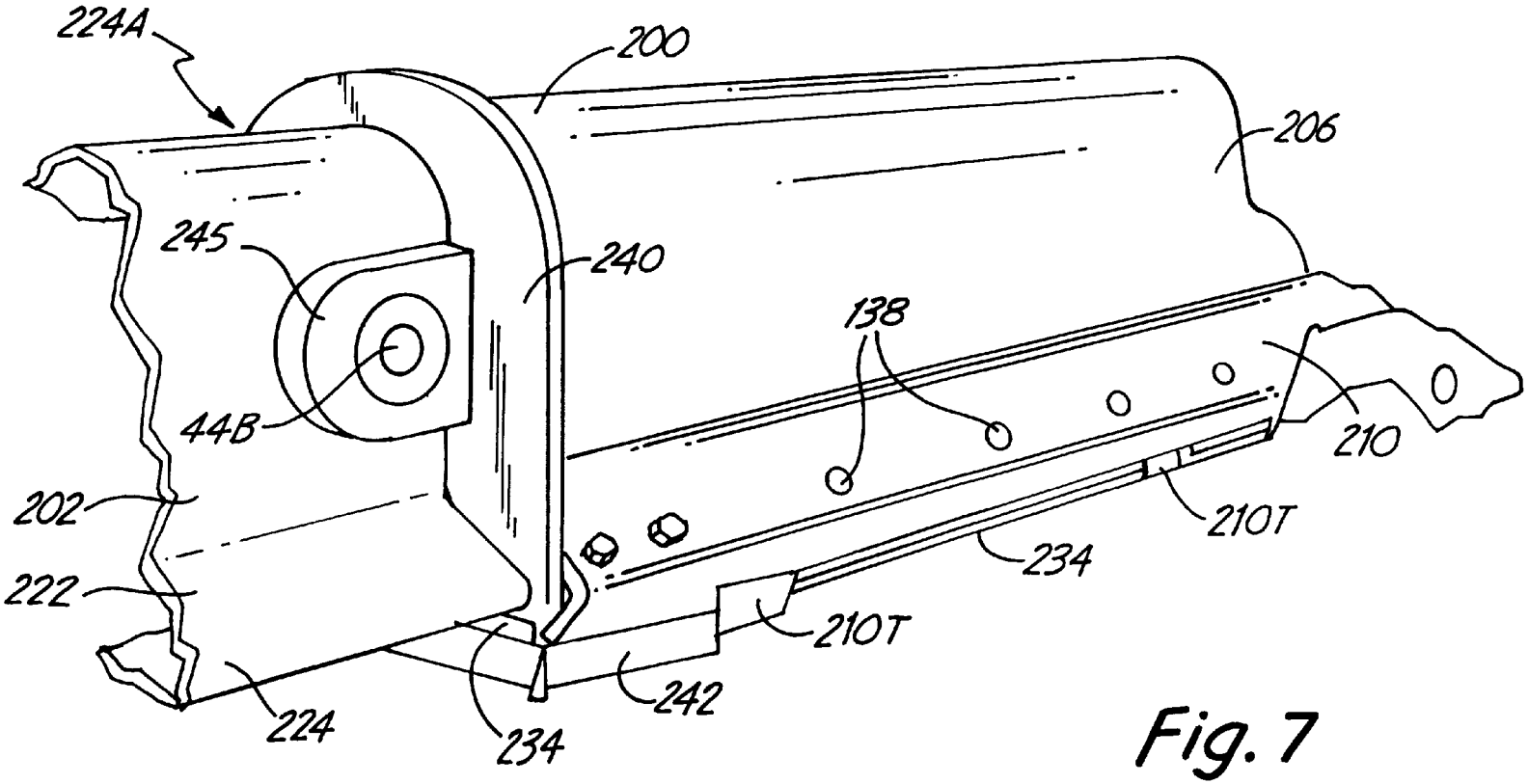
FIG. 7 is a fragmentary perspective view of the left lift arm, showing an outer end of an outer boom tube or housing shown in FIG. 6.

Suitable bolts 236 and 238 pass through apertures in the panels 210 and the flanges 235 on opposite sides of the lift arm. The bolts have nuts 236A and 238A. By tightening the nuts 236A and 238A, the inner lift arm tube 202 is moved upwardly as shown in FIG. 6, and can bear against shims or stops, if desired, so that the flanges 222 are loaded against the linear bearings 228 and are retained by the panels 210, as well as establishing the position of the inner lift arm tube relative to the outer lift arm tube in the vertical direction. The linear bearings 234 support the inner lift arm tube 202. As shown in FIG. 7, the bottom plate 234 can have notches on opposite sides and the flanges can have tabs 210T that fit into the notches to keep the parts from sliding longitudinally. A reinforcing collar 240 can be used at the outer end of the outer lift arm tube 200 for support of the side walls 206.

A heavier bar 242 also can be provided at the outer end of bottom wall 232 for deflection control and increasing rigidity. The bar 242 can be held in place with cap screws. Also support ears 245 on the inner lift arm tube used for the rod end pin 44B of the cylinder 244 will abut on collar 240 for a positive stop for retracting the inner lift arm tube.

In this form of the invention again the inner lift arm tube has a generally "bell" shaped cross section with lower ends of the side walls flared out and then curled back in along support panels or flanges that are perpendicular to the longitudinal vertical central plane of the boom. Wear adjustment is easily accomplished by having the adjustable bottom support plate and the lift arm can be assembled by taking the support plate 232 off and slipping the inner lift arm tube into the outer boom tube, and then clamping the support plate 232 against the bearings 234 to support the inner lift arm tube 202.

Figure 8:
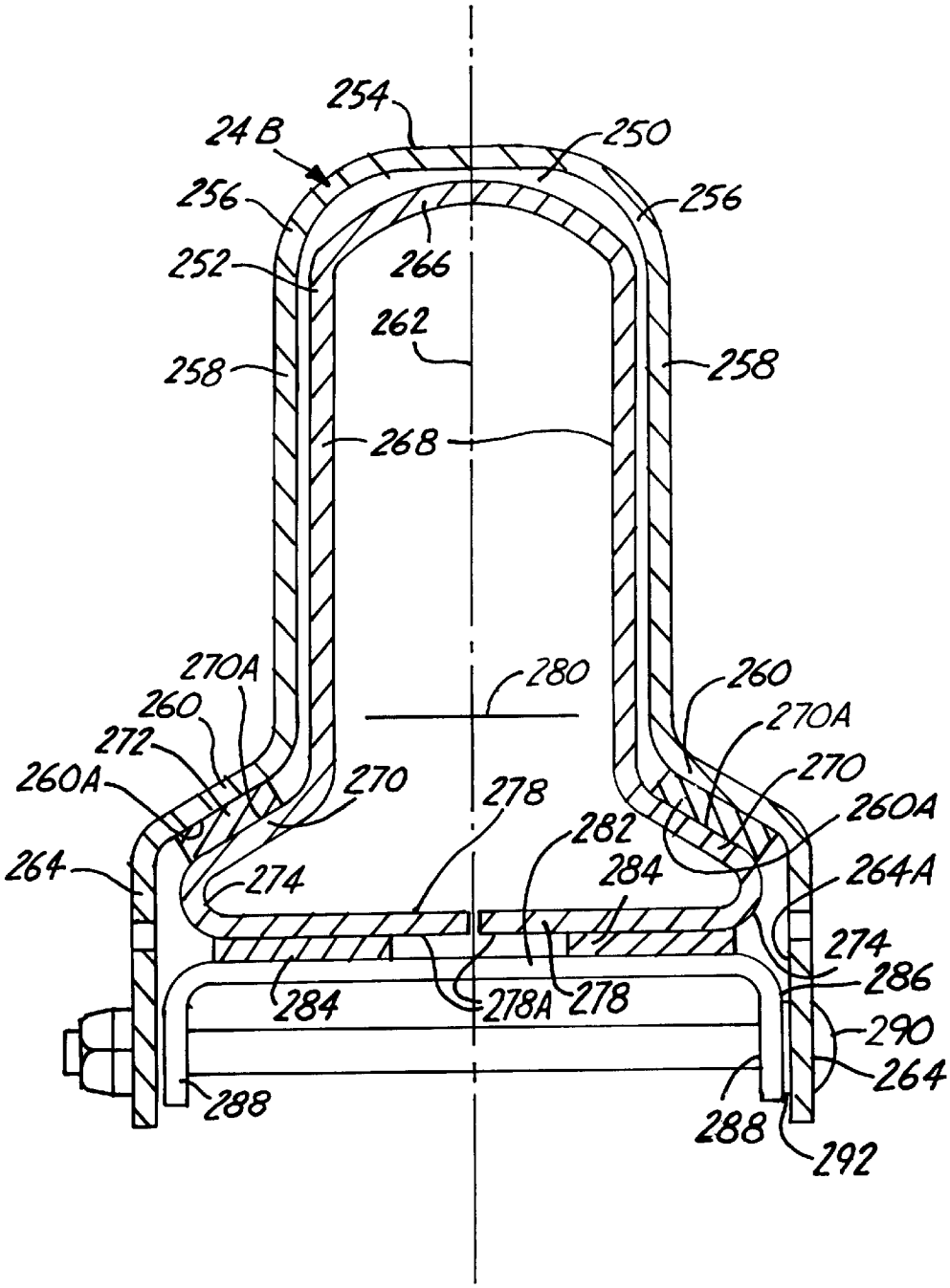
FIG. 8 is a cross sectional view of a lift arm of a still further modified form.

FIG. 8 shows a further modified form of the lift arm cross section, employing essentially the same bell-shaped cross section configuration, with the lower edge portions of the lift arm tubes flared outwardly to provide support surfaces that are inclined relative to the central plane of the lift arm. The lift arm assembly 24B includes an outer lift arm tube 250, and a telescoping inner lift arm tube 252, that nests inside the outer lift arm tube, and which will telescope longitudinally relative to the outer lift arm tube as previously explained.

In this form of the invention, the outer lift arm tube 250 has a rounded upper portion or wall 254 that has generally rounded edges 256, and vertical walls 258 that extend along the sides of the lift arm. The walls 258 are spaced apart and parallel, and the lower edge of the walls 258 of the outer lift arm tube 254 flare outwardly to form guide panels 260. Guide panels 260 are flared out at a desired angle relative to the central longitudinal plane 262 of the outer lift arm tube. The guide panels 260 are joined to substantially vertical wall sections 264 that extend downwardly a desired length. The planes of wall sections 264 are spaced laterally outwardly from the planes of the associated walls 258 a desired amount.

The inner lift arm tube 252 has a rounded upper portion 266 that fits below the upper wall 254 of the outer lift arm tube. The inner lift arm tube 252 also has parallel vertical walls 268 that are parallel to and spaced inwardly from the walls 258 of the outer lift arm tube. The lower ends of the walls 268 have integral, outwardly inclined flanges 270 that are parallel to the wall panels 260. The upper surfaces 270A of the flanges 270 are parallel to the inner surfaces 260A of the panels 260 on the outer lift arm tube. Linear bearings 272 are positioned between the flange surfaces 270A and the inner surfaces 260A of the panels 260, as previously shown in the other forms of the invention. The bell-shaped inner lift arm tube 252 has rounded lower corners 274 that join inwardly turned support flanges 278 that are perpendicular to the central longitudinally bisecting plane 262, and parallel to the plane indicated at 280, that is perpendicular to the plane 262.

The bell shaped end portions are formed by the flanges 270 and rounded portions 274 that fit between the side wall 164 that depend down from the panels 260.

The inner lift arm tube 252 in this form of the invention also can be assembled with the outer lift arm tube by slipping the inner lift arm tube up through the bottom opening of the outer boom tube 250. The inner lift arm tube is held in place with a retainer cross plate 282 that supports linear bearing pads 284 on its upper surface 282A. The pads 284 being in turn support inner surface 278A of the flanges 278.

The cross support plate 282 is adjustably held in a suitable manner between the walls 264. The cross plate 282 has flanges 288 that fit inside walls 264 and which can be clamped with a long bolt 290. The bolt can tightly clamp the walls 264 and 264A together. A spacer can be used over bolt 290, and shims also can be used between flanges 264 and 264A and flanges 288. The inner surfaces 260A wedge the linear bearings 272 down against flanges 270. This moves the inner lift arm tube 252 against linear bearings 284 and retainer plate 282. The adjustments for wear and original fit are easily made.

The inner lift arm tube 252 can be extended and retracted relative to the outer lift arm section using a hydraulic cylinder 44, as previously shown.

The various forms of the cross section of the lift arm all permit assembly by inserting the inner lift arm tube from the lower side of the outer lift arm tube, and then closing the bottom of the outer tube with a support or retainer plate that holds inner lift arm tube close to the wear pads on the flared walls or flanges of the bell-shaped inner lift arm tube as the fasteners are tightened.

Conventional telescoping lift arm structures have wear pads that support the inner lift arm structure on its top and bottom surfaces. During heavy lifting the top located wear pads concentrate compressive forces on the top surfaces between the inner and outer lift arm tube structures. Stresses in the lift arm tubes due to bending are increased at the wear pad contact points in conventional telescoping lift arms. It should be noted that in the forms of the present invention utilizing a bell shaped cross section, all the loads are carried near the lower side of the lift arms. The wear pads or linear bearings are loaded in compression below the neutral bending axis of the lift arms. Compressive stresses in the lower lift arm tube structures due to bending are counteracted by the contact tensile stresses of the wear pads and there is no compound loading on the upper part of the cylindrical sections of the lift arm tubes.

In the preferred form, mating surfaces of the bottom plate and outer lift arm tube side walls are shimmed so fasteners can be fully tightened. This will provide a clamping that holds the linear bearings properly loaded between the flanges of the outer and inner lift arm tubes for sliding fitting.

While the bottom supports or retainers have been called walls or plates, the supports could be made as several cross straps spaced along the length of the lift arms and individually adjustable.

It should be noted that in the form of the invention in FIGS. 1–4, the inner lift arm tube 42 is made in two parts. The upper inverted U-shaped channel and the bottom wall 76 are separately formed. The bottom wall 76 is welded in place. This allows better dimensional control, and a flat bottom surface for a bearing contact surface. The short bearing pads at the front and rear of the flared sections of the outer lift arm tube permits operation even when there is some deflection or bending of the inner lift arm tube from loads when extended. The front and rear bottom bearing 84 and 84A are secured by the bolts 94. The top front bearing pads 80 are secured with dowel pins to the outer lift arm tube and the rear top pads 80A are secured to the top surface of the inner lift arm tube by dowel pins.

Although the present invention has been described with reference to preferred embodiments, workers skilled in the art will recognize that changes may be made in form and detail without departing from the spirit and scope of the invention.

What is claimed is:

1. A telescoping lift arm assembly having a longitudinal axis and comprising an outer lift arm tube, and an inner lift arm tube, the outer lift arm tube having side wall portions that are spaced apart, and joined by a top wall, and the outer lift arm tube having a lower side, the side wall portions having outwardly flared panels extending at oblique angles relative to a central longitudinal plane bisecting the space between the side wall portions at the lower side of the outer lift arm tube, the inner lift arm tube fitted between the side wall portions of the outer lift arm tube and having outwardly flared flanges at a lower side parallel to the outwardly flared panels on the outer lift arm tube, and the inner lift arm tube having support surfaces at the lower side thereof, and a support plate mounted to the lower side of the outer lift arm tube and engaging the support surfaces of the inner lift arm tube to slidably hold the inner lift arm tube with the outwardly flared flanges underlying and adjacent the outwardly flared panels of the outer lift arm tube.

2. The telescoping lift arm assembly of claim 1, wherein the support surface of the inner lift arm tube comprises a generally planar surface of a cross wall joined to lower portions of the outwardly flared flanges of the inner lift arm tube.

3. The telescoping lift arm assembly of claim 2, wherein the cross wall has edge flanges angled from a plane formed by the generally planar surface of the wall, the edge flanges being secured to the outwardly flared flanges of the inner lift arm tube.

4. The telescoping lift arm assembly of claim 2 and bearings positioned between the outwardly flared flanges of the inner lift arm tube and the inner surfaces of the outwardly flared panels of the outer lift arm tube.

5. The telescoping lift arm assembly of claim 1, wherein the outer lift arm tube defines an open space between the side walls thereof having an open side, and the support plate closing the open side of the outer lift arm tube.

6. A telescoping lift arm assembly having a longitudinal axis and comprising an outer lift arm tube, and an inner lift arm tube, the outer lift arm tube having side wall portions that are spaced apart to define an open space, and joined by a top wall, and the outer lift arm tube having an open lower side, the side wall portions having outwardly flared panels extending at oblique angles relative to a central longitudinal plane bisecting the space between the side wall portions at the lower side of the outer lift arm tube, the inner lift arm tube fitted between the side wall portions of the outer lift arm tube and having outwardly flared flanges at a lower side parallel to the outwardly flared panels on the outer lift arm tube, the inner lift arm tube having support surfaces at the lower side thereof, and a support plate mounted to the lower side of the outer lift arm tube extending between the side wall portions and engaging the support surfaces of the inner lift arm tube to slidably hold at least portions of the inner lift arm tube with the outwardly flared flanges adjacent the outwardly flared panels of the outer lift arm tube, the support plate being mounted with fasteners that adjustably support the support plate on the outer lift arm tube in position to support the inner lift arm tube within the open space between the side wall portions of the outer lift arm tube.

7. The telescoping lift arm assembly of claim 5, wherein movement of the support plate causes the outwardly flared flanges of the inner lift arm tube to move relatively toward and away from the outwardly flared panels on the outer lift arm tube.

8. The telescoping lift arm assembly of claim 5, wherein said support plate has flanges on its edges that are generally parallel to the outwardly flared panels of the outer lift arm tube, and fasteners passing through the outwardly flared panels and the respective flanges of the support plate, the fasteners having axes generally perpendicular to the planes of outwardly flared panels of the outer lift arm tube and the flanges of the inner lift arm tube to provide direct clamping force between the support plate and the support surfaces at the lower side of the inner lift arm tube, and between the outwardly flared flanges of the inner lift arm tube relative to adjacent outwardly flared panels of the outer lift arm tube.

9. The telescoping lift arm assembly of claim 1 and a hydraulic actuator connected between the inner lift arm tube and the outer lift arm tube.

10. A telescoping lift arm assembly comprising an outer arm having side walls that flare outwardly at lower portions of the side walls, and have inner surfaces that face toward a center plane of the outer arm, a bell shaped cross section inner arm nested in the outer arm with outwardly extending wall portions forming the bell shape of the inner arm having outwardly facing surfaces nesting with the inner surfaces of the outwardly flared side walls of the outer arm, and a support plate secured to the outer arm to slidably support the inner arm with the outwardly extending wall portions forming the bell shape slidably guided by the inner surfaces of the outwardly flared side walls of the outer arm.

11. The telescoping lift arm of claim 10 wherein there are linear wear pads between the outwardly facing surfaces of the inner arm relative to the inner surfaces of the outwardly flared side walls of the outer arm.

12. The telescoping lift arm of claim 8, and fasteners for adjusting the support plate to urge the outwardly extending wall portions forming the bell shape of the inner arm toward the inner surfaces of the outwardly flared side walls of the outer arm.

13. The telescoping lift arm of claim 12, wherein the support plate and outer arm have facing surfaces, and removable shims between the facing surfaces, the facing surfaces moving together to clamp the shims when the fasteners are tightened.

14. The telescoping lift arm of claim 13, wherein the support plate extends laterally beyond the side walls of the outer arm, a bracket having a lip fixed to and extending laterally from the outwardly flared portions of the outer arm, the fasteners passing through the lip and edge portions of the support plate.

15. A telescoping arm assembly having a longitudinal axis, comprising an outer arm and an inner arm, the outer arm having longitudinally extending outer arm side wall portions that are spaced apart and joined by a top wall, the outer arm having a lower side, the outer arm side wall portions having first outwardly flared panels adjacent the lower side extending at oblique angles laterally outwardly relative to a central longitudinal plane bisecting the space between the outer arm side wall portions, the inner arm fitted between the outer arm side wall portions and having inner arm side wall portions complementary in shape to the outer arm side wall portions, the inner arm side wall portions having second outwardly flared panels adjacent to the first outwardly flared panels of the outer wall, the inner arm having a laterally extending support wall at a lower side thereof, and a removable support plate mounted to the lower side of the outer arm to slidably support the inner arm support wall and support the second inner arm outwardly flared panels adjacent to the outer wall first outwardly flared panels.

16. The telescoping arm assembly of claim 15, wherein the support plate is adjustably mounted to adjust the spacing between the second outwardly flared panels and the first outwardly flared panels.

17. The telescoping arm assembly of claim 16 and linear bearings positioned between the support wall and the support plate and between the mating surfaces of the first and second outwardly flared panels.

18. The telescoping arm assembly of claim 17, wherein the support plate is mounted to the outer arm with fasteners that clamp the support plate to the side walls of the outer arm.

19. The telescoping arm assembly of claim 15, wherein the support wall of the inner arm has a planar center portion supported by the support plate and side flanges extending upwardly and outwardly, and secured to the inner arm side wall portions.

20. The telescoping arm assembly of claim 17, the arm assembly having a first end pivotally mounted to frame of a prime mover, a power actuator for pivoting the arm assembly to raise and lower a load at a second end of the arm assembly, the arm assembly thereby being subjected to bending loads and having a neutral bending axis above the linear bearings.

21. A telescoping arm assembly comprising an outer arm having an inverted U-shape with spaced longitudinal outer side walls that have planar longitudinal flanges that flare outwardly at lower portions of the outer side walls, a bell shaped cross section inner arm nested in the outer arm including planar wall flared sections forming the bell shape nesting with and having outer surfaces slidably guided by lower surfaces of the planar outwardly flared flanges of the outer arm side walls.

22. The telescoping arm assembly of claim 21 and a plurality of wear pads between selected adjacent surfaces of the inner arm and outer arm.

23. The telescoping arm assembly of claim 21, wherein the inner arm has a lower support wall extending between the planar wall flared sections, the outer arm having a support plate extending between and supported on the outer arm side walls to support the lower support wall.

24. The telescoping arm assembly of claim 23, and fasteners for securing the support plate to the outer arm to adjustably support the inner arm to selectively move the planar wall flared sections toward the planar flanges of the outer arm side walls.

25. The telescoping arm assembly of claim 24, wherein the support plate is adjustable relative to the outer arm side walls to change the spacing between mating surfaces of the inner arm planar wall flared sections forming the bell shape and the planar flanges of the outer arm side walls.

26. The telescoping arm assembly of claim 22, wherein the telescoping arm assembly is mounted on a loader and is operable to lift loads which place bending loads on the arm assembly the arm assembly having a neutral bending axis, and the linear bearings being positioned on a lower side of the neutral bending axis.

27. The telescoping arm assembly of claim 21, wherein the inner arm and outer arms have the planar flanges and planar wall sections extending for a longitudinal length and a plurality of wear pads between the planar flanges and planar wall sections, the wear pads being located adjacent front and rear ends of the planar flanges and being longitudinally spaced apart to provide support for the inner arm.

* * * * *

UNITED STATES PATENT AND TRADEMARK OFFICE

CERTIFICATE OF CORRECTION

PATENT NO. : 6,726,437 B2
APPLICATION NO. : 10/123469
DATED : April 27, 2004
INVENTOR(S) : Larry E. Albright et al.

It is certified that error appears in the above-identified patent and that said Letters Patent is hereby corrected as shown below:

Title Page

(56) References Cited – please add the following references:

U.S. Patent Documents

| | | |
|---|---|---|
| 3,931,698 | 01/1976 | Ebersold |
| 4,257,201 | 03/1981 | Landolt et al. |

Foreign Patent Documents

| | | |
|---|---|---|
| P2001-262607 A | 09/2001 | Japan |
| 0 111 439 | 10/1983 | Europe |
| 2 502 132 | 09/1982 | France |
| DE 30 15 599 A1 | 10/1981 | Germany |
| P2001-262607 A | 09/2001 | Japan |

Signed and Sealed this

Second Day of October, 2007

JON W. DUDAS
*Director of the United States Patent and Trademark Office*